US005086951A

United States Patent [19]

Nakayama et al.

[11] Patent Number: 5,086,951

[45] Date of Patent: Feb. 11, 1992

[54] PORTABLE POST-MIX BEVERAGE DISPENSER UNIT

[75] Inventors: Shunichi Nakayama, Takasaki; Yasushi Takayanagi, Akabori; Yasuyuki Arai, Sakai, all of Japan

[73] Assignee: Sanden Corporation, Gunma, Japan

[21] Appl. No.: 421,587

[22] Filed: Oct. 11, 1989

[30] Foreign Application Priority Data

Oct. 11, 1988 [JP] Japan ..... 63-131731[U]

[51] Int. Cl.[5] ..... B67D 1/00

[52] U.S. Cl. ..... 222/129.1; 222/146.6

[58] Field of Search ..... 222/54, 146.6, 129.1, 222/129.2, 129.3, 145, 65, 399

[56] References Cited

U.S. PATENT DOCUMENTS

| | | | |
|---|---|---|---|
| 2,894,377 | 7/1959 | Shikles, Jr. et al. . | |
| 3,240,395 | 1/1963 | Carver | 222/129.1 |
| 3,638,392 | 2/1972 | Welker, Jr. et al. | 53/123 |
| 4,148,334 | 4/1979 | Richards | 222/129.1 |
| 4,304,736 | 12/1981 | McMillin et al. | 222/129.1 |
| 4,440,318 | 4/1984 | Berger | 222/129.1 |
| 4,493,441 | 1/1985 | Sedam et al. | 222/129.1 |
| 4,582,223 | 4/1986 | Kobe | 222/82 |
| 4,649,809 | 3/1987 | Kanezashi | 99/290 |
| 4,674,656 | 6/1987 | Wiley et al. | 222/129.1 |
| 4,688,701 | 8/1987 | Sedam | 222/129.1 |

FOREIGN PATENT DOCUMENTS

| | | |
|---|---|---|
| 0102527 | 3/1984 | European Pat. Off. . |
| 0181450 | 5/1986 | European Pat. Off. . |
| 0320262 | 6/1989 | European Pat. Off. . |
| 1414982 | 11/1975 | United Kingdom . |
| 2152011A | 7/1985 | United Kingdom . |

*Primary Examiner*—David M. Mitchell
*Assistant Examiner*—Christopher G. Trainor
*Attorney, Agent, or Firm*—Banner, Birch, McKie & Beckett

[57] ABSTRACT

A post-mix beverage dispensing system including a cabinet having top, front, back side and bottom panels for housing various components. The components include a carbonator for producing carbonated water by mixing cooled potable water with $CO_2$. Potable water is stored in a portable tank and is supplied to the carbonator through a first pipe. A cooling reservoir contains cooled water, and a serpentine section of the first pipe, along with the carbonator, are disposed in the cooling reservoir. A $CO_2$ tank supplies $CO_2$ to the carbonator and syrup packages. The flow rate of syrup from the syrup packages is kept constant by the pressure of $CO_2$ from the $CO_2$ tank. The front panel has a permanent magnet thereon, and the top panel has a reed switch thereon such that the permanent magnet is adjacent to the reed switch when the front panel is disposed on the cabinet. When an empty package is to be replaced with a new one and the front panel is opened, the reed switch is turned off, since the permanent magnet is spaced from the reed switch. An electromagnetic valve is thus cut off, and the supply of $CO_2$ from the $CO_2$ tank to the syrup packages is thereby stopped. The $CO_2$ is thus automatically prevented from venting to the atmosphere when the front panel is opened.

29 Claims, 3 Drawing Sheets

PORTABLE POST-MIX BEVERAGE DISPENSER UNIT

BACKGROUND OF THE INVENTION

The present invention relates to post-mix beverage dispensers which are compact, portable and suitable for use in small offices or small dispensing volume locations.

A post-mix beverage dispenser generally includes a syrup package having a flow control tube therein which is vented to the atmosphere, as shown in U.S. Pat. No. 4,493,441, which is hereby incorporated by reference. However, since there are some problems as to sanitation and lack of constancy of the flow rate of syrup in this dispenser, it is proposed to use a hermetic package as a syrup package and to use the pressure of the $CO_2$ from a $CO_2$ cylinder to vent the syrup, as shown in U.S. patent application Ser. No. 07/332,982, filed Apr. 4, 1989. However, when the syrup package is empty and to be replaced with another new one, a valve should be manually switched to prevent the venting of the $CO_2$.

SUMMARY OF THE INVENTION

It is a primary object of this invention to provide a portable post-mix dispenser unit the syrup bottle for which can be easily changed.

A post-mix dispensing system according to the present invention includes a cabinet housing which has at least a first access panel and an adjacent second access panel. A portable tank for storing potable water is detachable from the cabinet housing. A carbonator produces carbonated water by mixing cooled water from the portable tank with $CO_2$ from a $CO_2$ tank. A cooling reservoir cools potable water which is supplied from the portable tank to the carbonator. Syrup packages then dispense the selected syrup. A first pipe is partially disposed in the cooling reservoir for linking the portable tank with the carbonator. A second pipe links the $CO_2$ tank with the carbonator. A valve controls the flow of carbonated water from the carbonator. A third pipe links the carbonator with the valve. A fourth pipe links the second pipe to the syrup packages for supplying $CO_2$ from the $CO_2$ tank to the syrup packages to supply syrup to the valve. A control valve disposed on the fourth pipe opens and closes the communication between the $CO_2$ tank and the syrup package in accordance with signals from a detecting device which detects open and closed relationships between the first and second access panels.

Further objects, features and aspects of this invention will be understood from the following detailed description of preferred embodiments of this invention with reference to the accompanying drawings.

DETAILED DESCRIPTION OF PREFERRED EMBODIMENTS

Figure 1:
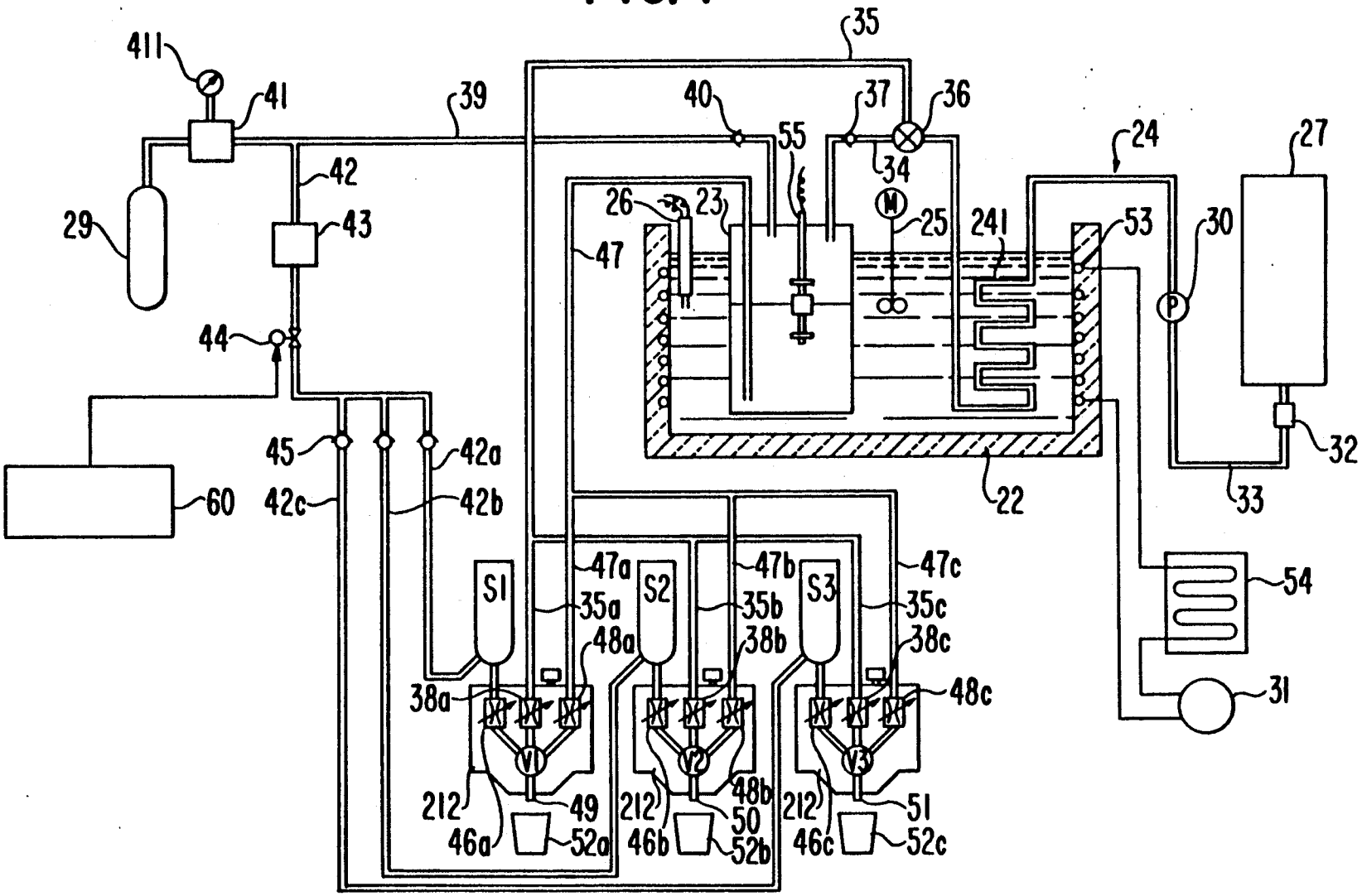
FIG. 1 is a schematic diagram of a mechanical refrigeration system of a portable post-mix beverage dispenser unit in accordance with one embodiment of the present invention.
Figure 2:
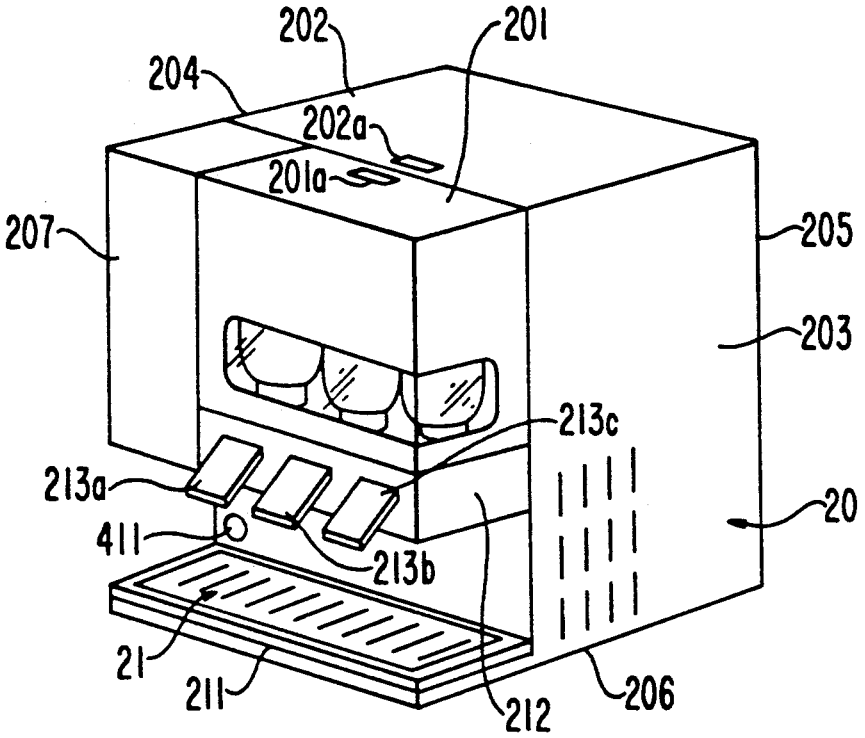
FIG. 2 is a front perspective view of the portable post-mix beverage dispenser unit of FIG. 1.
Figure 3:
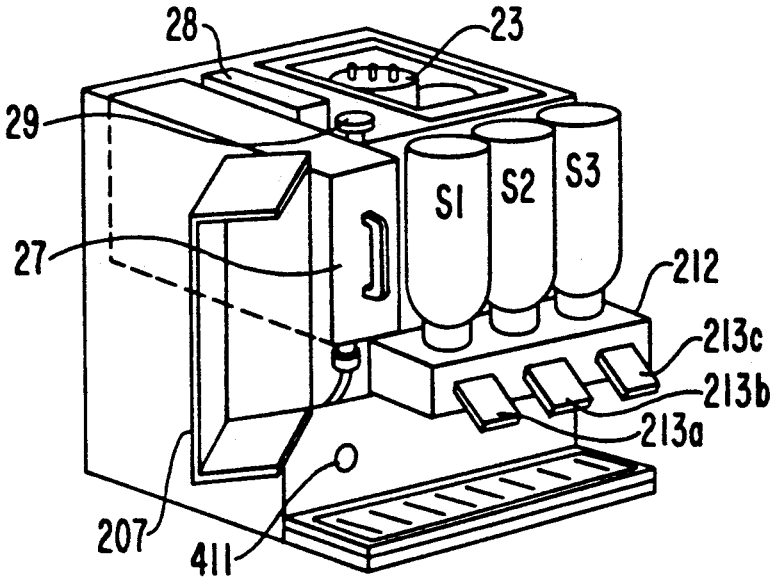
FIG. 3 is a front perspective view of the portable post-mix beverage dispenser unit of FIG. 2 with the front access panel and the top access panel thereof removed to illustrate the portable tank and syrup supply compartments.

With reference to FIGS. 1-3, a portable post-mix beverage dispenser unit in accordance with one embodiment of this invention is shown. The unit includes a cabinet shown generally at 20 having a front access panel 201, a top access panel 202, a right side access panel 203, a left side access panel 204, a rear side access panel 205, a bottom access panel 206 and an additional access panel 207. Front access panel 201 includes a permanent magnet **201*a* attached thereon adjacent the top access panel 202. Top access panel 202 in turn includes a reed switch 202*a* attached thereon adjacent the permanent magnet 201*a* on front access panel 201 so that the reed switch is turned on when the front access panel is located on cabinet 20. Permanent magnet 201*a* and reed switch 202*a* define a detecting device 60 to detect whether or not the front access panel 201 is positioned on cabinet 20**.

Pouring station 21 is located below front access panel 201 and includes a drain plate 211 for receiving cups and for draining liquid spilled from the cups through a plurality of drain plate slits. Dispensing portion 212 is located between panel 201 and pouring station 21 and includes valve levers **213*a*, 213*b*, 213*c* extending downwardly in front. Cooling reservoir 22 disposed in an upper corner of cabinet 20 is covered by an insulating material. A carbonator 23, part of cooling pipe 24, an agitator 25, and an ice sensor 26 are all disposed within cooling reservoir 22. Reservoir 22 stores cool water which is used for cooling potable water introduced to carbonator 23 through cooling pipe 24**.

Portable tank 27, which is removably disposed in an upper left side of cabinet 20, is used to store and supply potable water, to be both carbonated and mixed directly with the syrup. Control box 28, $CO_2$ cylinder or tank 29, and a plurality of syrup packages S1, S2, S3, which are located above and connected to dispensing portion 212, are disposed in an upper portion of cabinet 20. Pump 30, compressor 31 and condenser 54 in turn are disposed in a lower portion of cabinet 20. Portable tank 27 is linked to pump 30 through a sealing coupler 32 and a first conduit 33. Sealing coupler 32 connects one end of a first conduit 33 to the portable tank 27 such that the first conduit can be disconnected therefrom without any water leaking. First conduit 33 is further linked with pump 30 and on the other side of pump 30 is linked to cooling pipe 24. Cooling pipe 24 has a rectangular serpentine portion 241 disposed in cooling reservoir 22. The other end of cooling pipe 24 is linked to second conduit 34 and to third conduit 35 through a three-way electromagnetic valve 36. Second conduit 34 has a check valve 37 and extends into the carbonator 23 disposed in cooling reservoir 22. Third conduit 35 is divided into three sub-conduits **35*a*, 35*b*, 35*c*, each sub-conduit being coupled with a respective valve V1, V2 or V3 through respective flow control valves 38*a*, 38*b* and 38*c* disposed in dispensing portion 212**.

$CO_2$ cylinder 29 is linked to the interior of carbonator 23 through fourth conduit 39. Check valve 40 and reducing valve 41 including a pressure gauge 411 are disposed in fourth conduit 39 between cylinder tank 29 and carbonator 23. Carbonated water is produced in carbonator 23 by mixing cooled water from portable tank 27 with $CO_2$ from $CO_2$ cylinder 29.

Fifth conduit 42 is linked to fourth conduit 39 at a location between reducing valve 41 and check valve 40. Fifth conduit 42 includes a reducing valve 43 and an electromagnetic valve 44. Downstream of the electromagnetic valve 44, the fifth conduit 42 splits into three subconduits 42*a*, 42*b*, 42*c*, each one having a respective check valve 45*a*, 45*b*, 45*c*. Subconduits 42*a*, 42*b* and 42*c* are linked to syrup packages S1, S2 and S3, respectively, and are further linked with valves V1, V2 and V3, respectively, through respective flow control valves 46*a*, 46*b*, 46*c*. Reducing valve 43 reduces the pressure of $CO_2$ within fifth conduit 42 to a level of about 0.4 kg/cm$^2$.

Carbonator 23 maintains cooled carbonated water therein. Sixth conduit 47 extends from near the bottom of carbonator 23 at one end and is divided into three subconduits 47*a*, 47*b* and 47*c* at the other end. Subconduits 47*a*, 47*b* and 47*c* are coupled with valves V1, V2 and V3, respectively, through respective flow control valves 48*a*, 48*b*, 48*c*. Valves V1, V2 and V3 are connected at their other ends to nozzles 49, 50 and 51, respectively, to dispense mixed beverages into respective cups 52*a*, 52*b* and 52*c*.

Evaporator 53 is disposed along the outer surface of the inner wall of cooling reservoir 22 and cools the water in the cooling reservoir. Evaporator 53 forms part of a refrigeration circuit which also includes compressor 31 and condenser 54 located outside of cooling reservoir 22 but within cabinet 20. The water in the reservoir 22 is cooled by the evaporator 53 until it is at a temperature of about zero degrees Centigrade.

Electromagnetic valve 44 is connected to control device 60, and opens and closes communication of fifth conduit 42 between reducing valve 43 and check valves 45*a*, 45*b*, and 45*c* in accordance with instructions from the detecting device 60.

In operation, a user places a cup 52*a*, 52*b* or 52*c* on drain plate 211 below the nozzle 49, 50 or 51 corresponding to the selected beverage. He then pushes one of valve levers 213*a*, 213*b*, 213*c* which corresponds to the selected nozzle, which simultaneously operates pump 30 and three-way electromagnetic valve 36. Pump 30 pumps water from portable tank 27 through first conduit 33 and into serpentine portion 241 of cooling pipe 24, where it is cooled by the cooling water in reservoir 22. Thereafter, the water flows through three-way electromagnetic valve 36 into carbonator 23 where it is mixed with $CO_2$ from $CO_2$ cylinder 29 to thereby carbonate the water. Float switch 55 controls the volume of carbonated water in carbonator 23. If the level of carbonated water is below a predetermined level, pump 30 operates and more potable water, in the form of mist or spray, is supplied to carbonator 23 along with $CO_2$ to raise the level of carbonated water back to the predetermined level.

Figure 4:
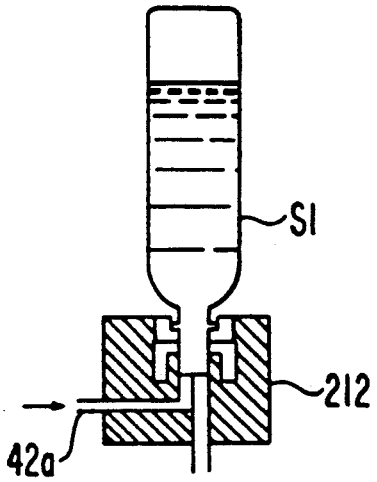
FIG. 4 is a cross-sectional view showing the connection of a syrup package to the unit of FIG. 1.
Figure 5:
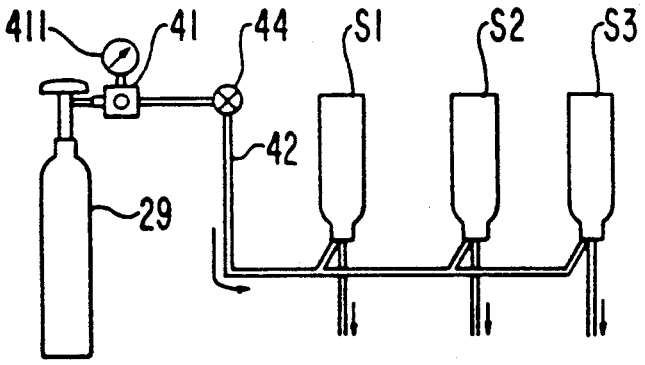
FIG. 5 is a schematic diagram showing a portion of the portable post-mix beverage dispenser unit of FIG. 1.

Carbonated water mixed in carbonator 23 flows through sixth conduit 47, and through the appropriate subconduit to respective flow control valves 48*a*, 48*b*, 48*c*. Additionally, potable water is sent directly to flow control valves 38*a*, 38*b*, 38*c* in dispensing portion 212 through third conduit 35 and the appropriate subconduit from electromagnetic valve 36. In other words, water also flows from serpentine portion 241 without passing through carbonator 23. Finally, syrup flows from one of the appropriate syrup packages S1, S2, S3 to the respective flow control valves 46*a*, 46*b*, 46*c* due to the pressure of the $CO_2$ in conduit 42 and the corresponding subconduit. Since the $CO_2$ in conduit 42 and subconduit 42*a*, for example, is supplied to the interior of syrup package S1 as shown in FIGS. 4 and 5 and the pressure of the $CO_2$ is constant, the flow rate of syrup from syrup package S1 to flow control valve 46 is also constant. The volumes of carbonated water, potable water and syrup are controlled at flow control valves 48, 38 or 46 and are supplied to the associated valves V1, V2 or V3 where they are mixed. The mixed beverages then flow through the associated nozzles 49, 50, 51 to cups 52*a*, 52*b*, 52*c*.

Figure 6:
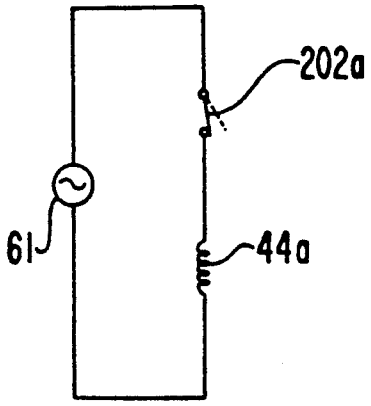
FIG. 6 is an electrical circuit for driving the electromagnetic valve of the system of FIG. 1.

$CO_2$ cylinder 29 and syrup packages S1, S2 and S3 are detachable relative to the cabinet 20. Thus, when the tank or syrup packages are empty, they can be removed and replaced with fresh ones. Accordingly, when the front access panel 201 is moved away from cabinet 20 to access the tank or syrup packages, permanent magnet 201*a* attached on front access panel 201 is spaced from reed switch 202*a* attached on top access panel 202. Reed switch 202*a* is thereby turned off and electric current from power source 61, as shown in FIG. 6, cut off to solenoid 44*a* of electromagnetic valve 44. Electromagnetic valve 44 thus closes the communication between fifth conduit 42 and its respective subconduits 42*a*, 42*b* and 42*c*. The supply of the $CO_2$ to syrup packages S1, S2 and S3 is stopped at electromagnetic valve 44. Therefore, even though one or more of syrup packages S1, S2 and S3 are removed from corresponding subconduits 42*a*, 42*b* and 42*c*, the $CO_2$ from $CO_2$ cylinder 29 does not vent to the atmosphere.

After the tank and/or one or more of the packages have been replaced with fresh ones and front access panel 201 closed and disposed on dispensing portion 212, permanent magnet 201*a* is adjacent to reed switch 202*a*, and solenoid 44*a* of electromagnetic valve 44 is thus connected to power source 61. Electromagnetic valve 44 accordingly opens the communication between fifth conduit 42 and respective subconduits 42*a*, 42*b* and 42*c*, and thereby starting supply of the $CO_2$ to syrup packages S1, S2 and S3.

This invention has been described in connection with preferred embodiments thereof. The preferred embodiments, however, are merely for example only, and the invention is not restricted thereto. It can be understood by those skilled in the art that variations and modifications can be easily made within the scope of this invention as defined by the appended claims.

What is claimed is:

1. A post-mix dispensing system including a cabinet housing having a first access panel and a second access panel adjacent thereto, portable tank means for storing potable water, said portable tank means being detachable from said cabinet housing, carbonator means for producing carbonated water by mixing cooled water from said portable tank means with $CO_2$, cooling reservoir means for cooling potable water supplied from said portable tank means to said carbonator means, $CO_2$ tank means for supplying $CO_2$ to said carbonator means, syrup package means for dispensing a selected syrup, first pipe means partially disposed in said cooling reservoir means for linking said portable tank means with said carbonator means, second pipe means for linking said $CO_2$ tank means with said carbonator means, valve means for controlling the flow of carbonated water from said carbonator means, third pipe means linking said carbonator means with said valve means, and fourth pipe means linking said second pipe means to said syrup package means for supplying $CO_2$ from said $CO_2$ tank means to said syrup package means to supply syrup from said syrup package means to said valve means, wherein the improvement comprises:

detecting means for detecting relative open and closed positions of said first and second access panels; and control valve means disposed on said fourth pipe means for opening and closing the communication between said $CO_2$ tank means and said syrup package means in accordance with at least one signal from said detecting means.

2. The post-mix beverage dispensing system of claim 1 wherein said control valve means is an electromagnetic valve.

3. The post-mix beverage dispensing system of claim 1 wherein said detecting means includes a permanent magnet attached to said first access panel and a reed switch attached to said second access panel.

4. The post-mix beverage dispensing system of claim 3 wherein said carbonator means is disposed in said cooling reservoir means.

5. The post-mix beverage dispensing system of claim 4 further comprising sealing coupler means disposed between said portable tank means and said carbonator means for allowing said portable tank means to be detached without water leaking.

6. The post-mix beverage dispensing system of claim 5 further comprising fifth pipe means, linked to said first pipe means through a three-way electromagnetic valve at one end and linked to said valve means at its other end, for supplying cooled potable water from said portable tank means to said valve means, and said valve means mixing and dispensing the carbonated water, the syrup and the cooled potable water.

7. The post-mix beverage dispensing system of claim 6 further comprising sixth pipe means, linked to said first pipe means through a three-way electromagnetic valve at one end and linked to said valve means at its other end, for supplying carbonated water from said carbonator means to said valve means.

8. The post-mix beverage dispensing system of claim 7 wherein said first pipe means includes a serpentine portion disposed in said cooling reservoir means for rapidly cooling potable water from said portable tank means.

9. The post-mix beverage dispensing system of claim 8 wherein said carbonator means stores carbonated water produced therein, and further comprising sensing means disposed in said carbonator means for sensing the level of carbonated water stored in said carbonator means.

10. The post-mix beverage dispensing system of claim 9 further comprising pump means disposed in said first pipe means between said portable tank means and said carbonator means for pumping potable water from said portable tank means to said carbonator means.

11. The post-mix beverage dispensing system of claim 10 wherein said first access panel is a front panel, said second access panel is a top panel, and said cabinet housing has further back, side and bottom panels.

12. A beverage dispensing system comprising:

a syrup package station;

communicating means for communicating a source of $CO_2$ pressure to a syrup package operatively connected to said station;

access means movable between open and closed positions for providing access to said station and, when in the open position, to the syrup package at said station;

detecting means for detecting when said access means is in other than the closed position and generating a signal corresponding thereto; and control means activated by the corresponding signal for shutting off the supply of $CO_2$ pressure through said communicating means generally to said station when said access means is generally in other than the closed position to prevent $CO_2$ from venting to the atmosphere in the event that no syrup package is generally at said station and operatively connected to said communicating means.

13. The beverage dispensing system of claim 12 further comprising delivering means for delivering carbonated water to the syrup package operatively connected at said station.

14. The beverage dispensing system of claim 12 wherein said communicating means includes a connector pipe and said control means includes a valve in said connector pipe.

15. The beverage dispensing system of claim 14 wherein said valve comprises a solenoid-actuated electromagnetic valve.

16. The beverage dispensing system of claim 12 wherein said detecting means comprises a magnet and reed switch assembly associated with said access means.

17. The beverage dispensing system of claim 16 further comprising a panel associated with said station and with respect to which said access means moves, and said magnet reed switch assembly including (1) a magnet secured to one of said panel and said access means and (2) a reed switch secured to the other of said panel and said access means.

18. The beverage dispensing system of claim 12 wherein said access means, when in the open position, provides access to said station sufficient to replace a syrup package thereat.

19. The beverage dispensing system of claim 12 further comprising compartment means for holding a $CO_2$ cylinder for providing the source of $CO_2$ pressure for said communicating means, and said access means when in the open position providing access to said compartment means sufficient for replacement of a $CO_2$ cylinder thereat.

20. The beverage dispensing system of claim 12 wherein said station includes a plurality of connectors each for a separate syrup package thereat, said communicating means includes a primary conduit and a branching conduit system connecting said primary conduit with each of said connectors, and said control means includes an electromagnetic valve in said primary conduit and before said branching conduit system.

21. The beverage dispensing system of claim 12 wherein said access means includes a front access panel.

22. The beverage dispensing system of claim 12 wherein said communicating means comprises a conduit, and said control means comprises a valve on said conduit.

23. The beverage dispensing system of claim 22 wherein said valve comprises an electromagnetic valve.

24. The beverage dispensing system of claim 23 wherein said detecting means comprises switch means for cutting off electrical power to said electromagnetic valve.

25. The beverage dispensing system of claim 12 further comprising dispensing valve means for controlling the flow of syrup out of a syrup package connected at said station.

26. The beverage dispensing system of claim 25 wherein said dispensing valve means is positioned directly below the syrup package connected at said station.

27. The beverage dispensing system of claim 12 further comprising said syrup package station defining a first syrup package station, a second syrup package station adjacent to said first syrup package station, and said access means, when in the open position, providing access to said second syrup package station.

28. The beverage dispensing system of claim 27 further comprising said communicating means defining a first communicating means, and second communicating means for communicating the source of $CO_2$ pressure to a syrup package connected at said second syrup package station.

29. The beverage dispensing system of claim 28 wherein said control means, when activated by the corresponding signal, shuts off the supply of $CO_2$ pressure through said second communicating means generally to said second syrup station when said access means is generally in other than the closed position to prevent $CO_2$ from the source from venting in the event no syrup package is at said second syrup station and operatively connected to said second communicating means.

* * * * *